US011505398B2

(12) United States Patent
Fortini et al.

(10) Patent No.: US 11,505,398 B2
(45) Date of Patent: Nov. 22, 2022

(54) PACKET OF SMOKING ARTICLES AND METHOD FOR MANUFACTURING THE SAME

(71) Applicant: G.D SOCIETA' PER AZIONI, Bologna (IT)

(72) Inventors: Massimo Fortini, Granarolo Emilia (IT); Luca Federici, Bologna (IT)

(73) Assignee: G.D SOCIETA' PER AZIONI, Bologna (IT)

( * ) Notice: Subject to any disclaimer, the term of this patent is extended or adjusted under 35 U.S.C. 154(b) by 86 days.

(21) Appl. No.: 16/977,030

(22) PCT Filed: Mar. 1, 2019

(86) PCT No.: PCT/IB2019/051675
§ 371 (c)(1),
(2) Date: Aug. 31, 2020

(87) PCT Pub. No.: WO2019/167019
PCT Pub. Date: Sep. 6, 2019

(65) Prior Publication Data

US 2020/0407155 A1 Dec. 31, 2020

(30) Foreign Application Priority Data

Mar. 1, 2018 (IT) ..... 102018000003168

(51) Int. Cl.
*B65D 85/10* (2006.01)

(52) U.S. Cl.
CPC ..... *B65D 85/1056* (2020.05)

(58) Field of Classification Search
CPC ..... B65D 85/1056; B65D 85/10564; B65D 85/10568; B65D 85/10; B65D 85/1045
(Continued)

(56) References Cited

U.S. PATENT DOCUMENTS

| | | | | |
|---|---|---|---|---|
| 8,123,030 | B2 | 2/2012 | Hein | |
| 2018/0105318 | A1* | 4/2018 | Bellamah | B65D 5/4295 |
| 2019/0225410 | A1 | 7/2019 | Hafker | |

FOREIGN PATENT DOCUMENTS

| | | | |
|---|---|---|---|
| DE | 102008035467 | A1 | 2/2010 |
| DE | 102009036116 | A1 | 2/2011 |

(Continued)

OTHER PUBLICATIONS

International Search Report and Written Opinion, corresponding International Application No. PCT/IB2019/051675, dated May 24, 2019.

(Continued)

*Primary Examiner* — Rafael A Ortiz
(74) *Attorney, Agent, or Firm* — Marshall, Gerstein & Borun LLP

(57) ABSTRACT

A packet of smoking articles and method for manufacturing the same, wherein the packet comprises: a group of smoking articles; a wrapping, which encloses the group of smoking articles and that comprises an extraction opening, defined by an edge, for extracting the smoking articles from the wrapping; a closing label, which is fixed to the wrapping and that is mobile between a closing position, in which it closes the extraction opening, and an opening position, in which the access to the group of smoking articles is allowed; a covering element, which is fixed to the closing label and that faces and covers the extraction opening when the closing label is in the closing position.

8 Claims, 9 Drawing Sheets

(58) Field of Classification Search
USPC ..... 206/265, 242, 271, 273, 274
See application file for complete search history.

(56) References Cited

FOREIGN PATENT DOCUMENTS

| | | | | |
|---|---|---|---|---|
| EP | 2361839 | A1 | 8/2011 | |
| WO | WO-2002/079051 | A1 | 10/2002 | |
| WO | WO-2013/120915 | A1 | 8/2013 | |
| WO | WO-2016/087818 | A1 | 6/2016 | |
| WO | WO-2016/087819 | A1 | 6/2016 | |
| WO | WO-2016/087827 | A1 | 6/2016 | |
| WO | WO-2017/167802 | A1 | 10/2017 | |
| WO | WO-2017167802 | A1 * | 10/2017 | ..... B65D 85/1045 |
| WO | WO-2018/024375 | A1 | 2/2018 | |

OTHER PUBLICATIONS

PCT Third Party Observations Submitted in International Application No. PCT/IB2019/051675 dated May 2, 2020.

* cited by examiner

PACKET OF SMOKING ARTICLES AND METHOD FOR MANUFACTURING THE SAME

CROSS-REFERENCE TO RELATED APPLICATION

This application is a U.S. national phase of International Patent Application No. PCT/IB2019/051675 filed Mar. 1, 2019, which claims the benefit of priority from Italian Patent Application No. 102018000003168 filed on Mar. 1, 2018, the respective disclosures of which are each incorporated herein by reference in their entireties.

TECHNICAL FIELD

The present invention relates to a packet of smoking articles and to the respective method for manufacturing the same.

PRIOR ART

A packet of smoking articles is known, which comprises: a group of smoking articles; a wrapping, which encloses the group of smoking articles and comprises an extraction opening for extracting the smoking articles from the wrapping, the which extraction opening is defined by an edge; a closing label, which is glued to the wrapping and that is mobile between a closing position, in which it closes the extraction opening of the wrapping, and an opening position, in which the access to the group of smoking articles is allowed.

Furthermore, the packet comprises a covering element, which is fixed to the closing label and faces and covers the extraction opening when the closing label is in the closing position. In particular, said covering element has the function of preventing the glue of the closing label from adhering to the smoking articles at the extraction opening of the wrapping.

In detail, the covering element of the known packet described above is dimensioned to protrude beyond the entire edge of the extraction opening. In other words, the covering element protrudes beyond all sides of the extraction opening.

However, the aforementioned packet requires a considerable use of wrapping materials and this results in a considerable production cost of the packet.

Patent applications WO2017167802A1, WO2016087827A1 and EP2361839A1 describe a packet of smoking articles provided with a closing label which is mobile between a closing position in which it closes an extraction opening of the smoking articles, and an opening position in which it allows access to the extraction opening of the smoking articles.

DESCRIPTION OF THE INVENTION

The object of the present invention is to provide a packet of smoking articles, and a method for manufacturing the same, which overcomes the aforementioned drawbacks.

The aforesaid purpose has been obtained by means of a packet of smoking articles and a relative method according to the attached claims.

Advantageously, the proposed packet ensures that the glue of the closing label is not in contact with the smoking articles arranged in the wrapping and, at the same time, it allows to minimize (with respect to the known packet described above) the quantity of material used for manufacturing the packet itself.

BRIEF DESCRIPTION OF THE DRAWINGS

The present invention will now be described with reference to the attached drawings, which illustrate a non-limiting embodiment, wherein.

PREFERRED EMBODIMENTS OF THE INVENTION

With reference to the attached Figures, a packet of smoking articles object of the present invention has been denoted generally with the reference number 1.

The term "smoking articles" refers to articles of the tobacco field such as, for example, traditional cigarettes, cigars, new generation cigarettes (for example, heat-not-burn type). In general, as is known, a smoking article is a tubular element having a longitudinal development.

With reference to FIGS. 1, 2, 5-7, a first embodiment of the packet 1 object of the present invention is described in the following.

Figure 1:
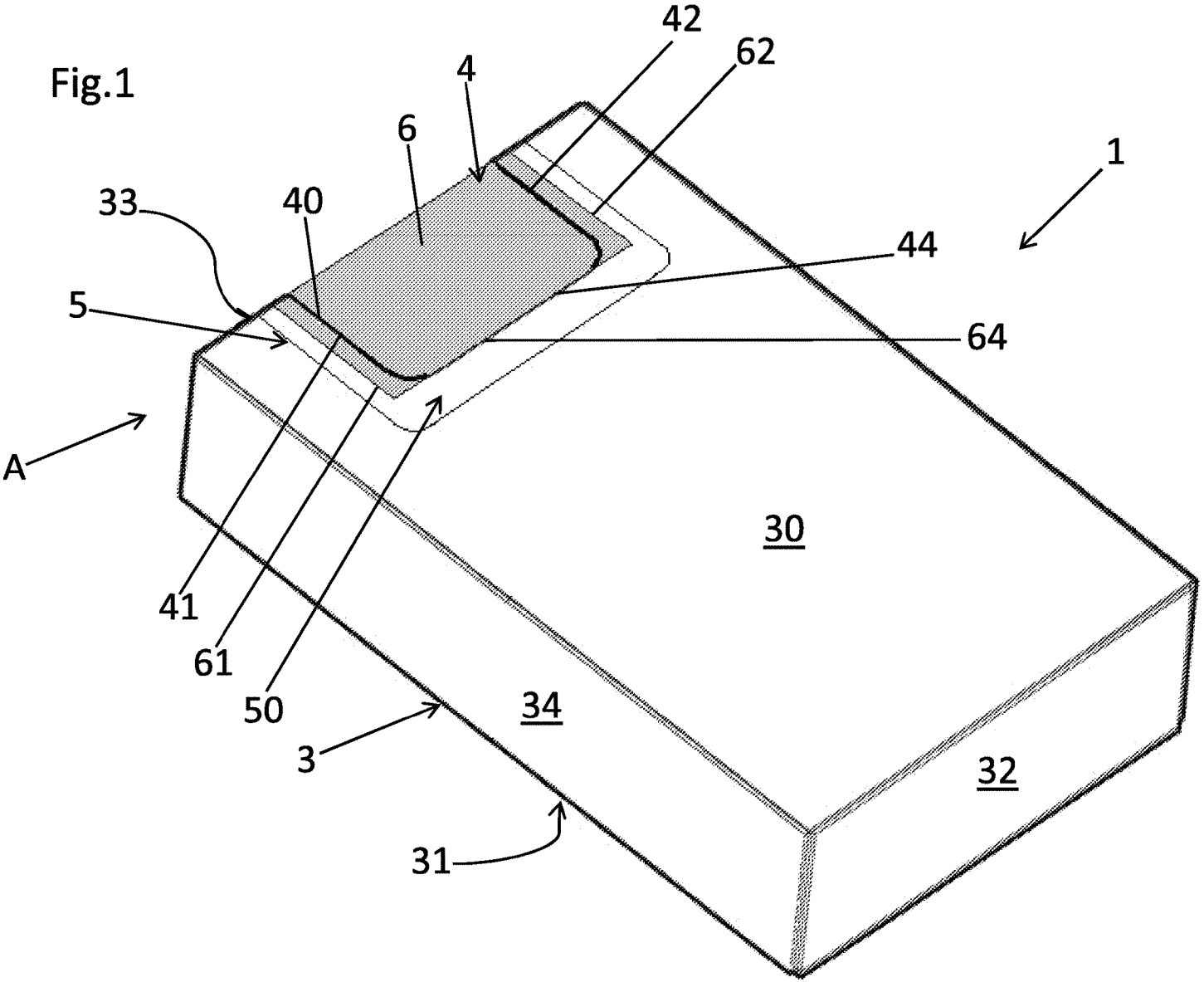
FIG. 1 is a perspective view of an embodiment of the packet of smoking articles object of the present invention.

With particular reference to FIG. 1, the packet 1 of smoking articles comprises: a group of smoking articles (not shown in FIG. 1); a wrapping 3, which encloses the group of smoking articles 2 and that comprises an extraction opening 4 for extracting the smoking articles 2 from the wrapping 3, the which extraction opening 4 is defined by an edge 40; a closing label 5, which is fixed to the wrapping 3 and that is mobile between a closing position A, in which it closes the extraction opening 4 of the wrapping 3, and an opening position B, in which the access to the group of smoking articles 2 is allowed; a covering element 6, which is fixed to the closing label 5 and that faces and covers (in particular, completely) the extraction opening 4 when the closing label 5 is in the closing position A.

According to the present invention, the covering element 6 protrudes beyond the edge 40 of the extraction opening 4 at a partial part of the edge 40, when the closing label 5 is in the closing position A.

In other words, the covering element 6 protrudes beyond the edge 40 of the extraction opening 4 for a single part of the edge 40 and not beyond the entire edge 40.

Advantageously, the proposed packet 1 ensures that the closing label 5 (in particular, the glue of the closing label 5) is not in contact with the smoking articles 2 arranged inside the wrapping 3 and, at the same time, minimizes the quantity of material used for the manufacturing the packet 1.

With further reference to FIG. 1, the wrapping 3 has a substantially rectangular parallelepiped shape. In detail, the wrapping 3 comprises a front wall 30, a rear wall 31 opposed and parallel to the front wall 30, a bottom wall 32, an upper wall 33 opposed and parallel to the bottom wall 32 and a pair of lateral sides 34 which are opposed and parallel to one another and which are orthogonal to the front wall 30 and to the rear wall 31. Four longitudinal edges are defined between the front walls 30, the rear walls 31 and the lateral sides 34 of the wrapping 3. Four transverse edges are defined between the front wall 30, the rear wall 31, the lateral sides 34 and the bottom wall 32. Similarly, four transverse edges are also defined between the front wall 30, the rear wall 31, the lateral sides 34 and the upper wall.

It is understood that the wrapping 3 can have a different shape than that illustrated (for example, the wrapping can have rounded edges).

The extraction opening 4 is made in the front wall 30 and at the upper wall 33 of the wrapping 3. As an alternative to what has been illustrated, the extraction opening 4 could also extend also at the rear wall 31 of the wrapping 3 or could extend only at the front wall 30 or only at the upper wall 33.

The wrapping 3 is obtained by folding a sheet 3' having a prevalent development direction X.

Figure 2:
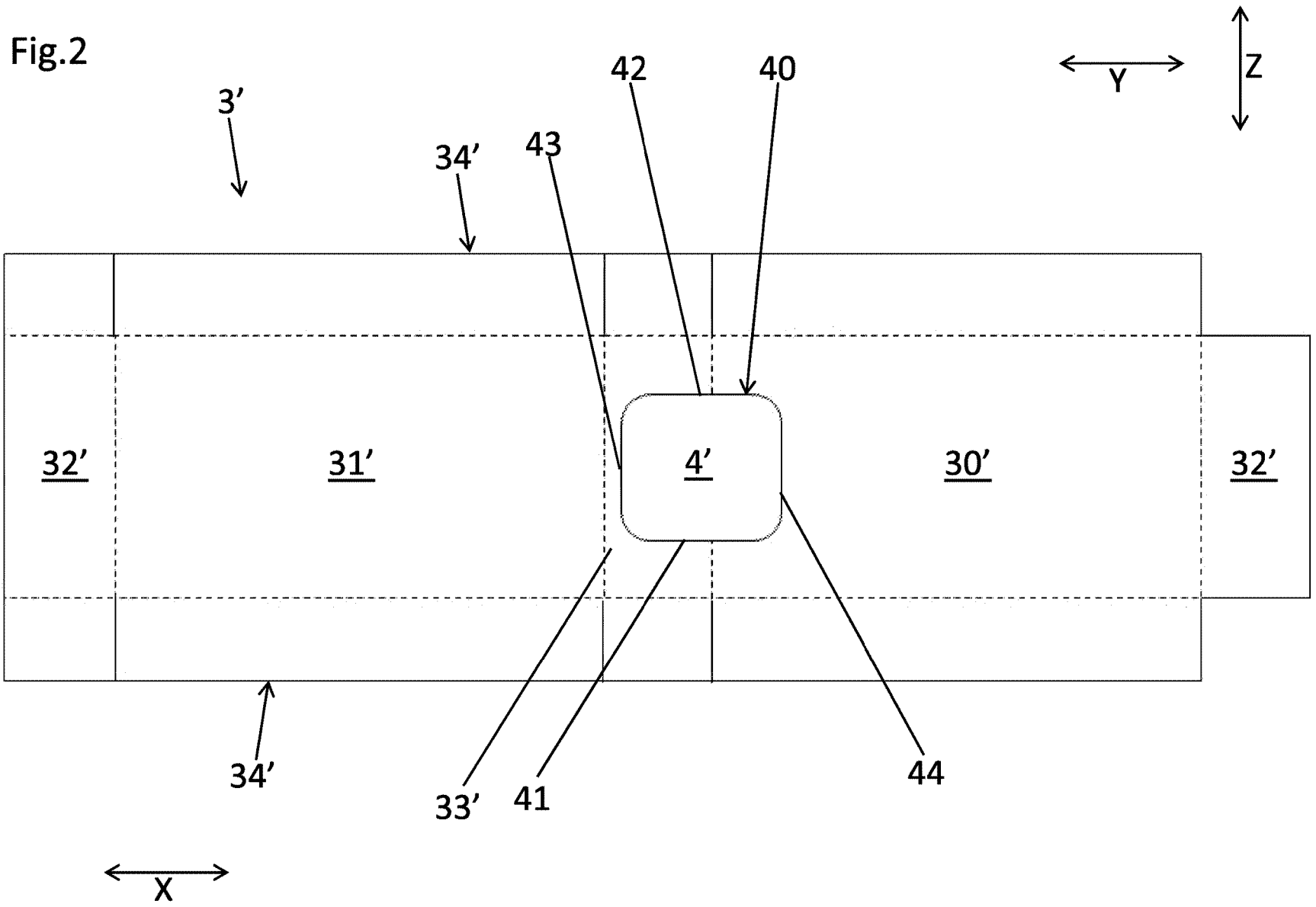
FIG. 2 is a plan view of a sheet of material for manufacturing the wrapping of the packet of FIG. 1.

In particular according to the embodiment of FIG. 1, the sheet 3' having a prevalent development direction X, which is designed to form the wrapping 3, is a blank (FIG. 2). Therefore, the wrapping 3 is made of a material sufficiently rigid to maintain the parallelepiped shape.

The blank 3' can be made of a material made of a single layer (for example, cardboard) or of a multilayer material. In the latter case, for example, the blank 3' can comprise a layer of cardboard which will form the outside of the wrapping 3 and a layer of foil (in turn formed of an aluminium layer and a paper layer) which will form the inside of the wrapping 3.

In FIG. 2 the various parts of the blank 3' have been denoted, where possible, with accented reference numbers equal to the reference numbers that distinguish the corresponding parts of the wrapping 3.

Figure 3:
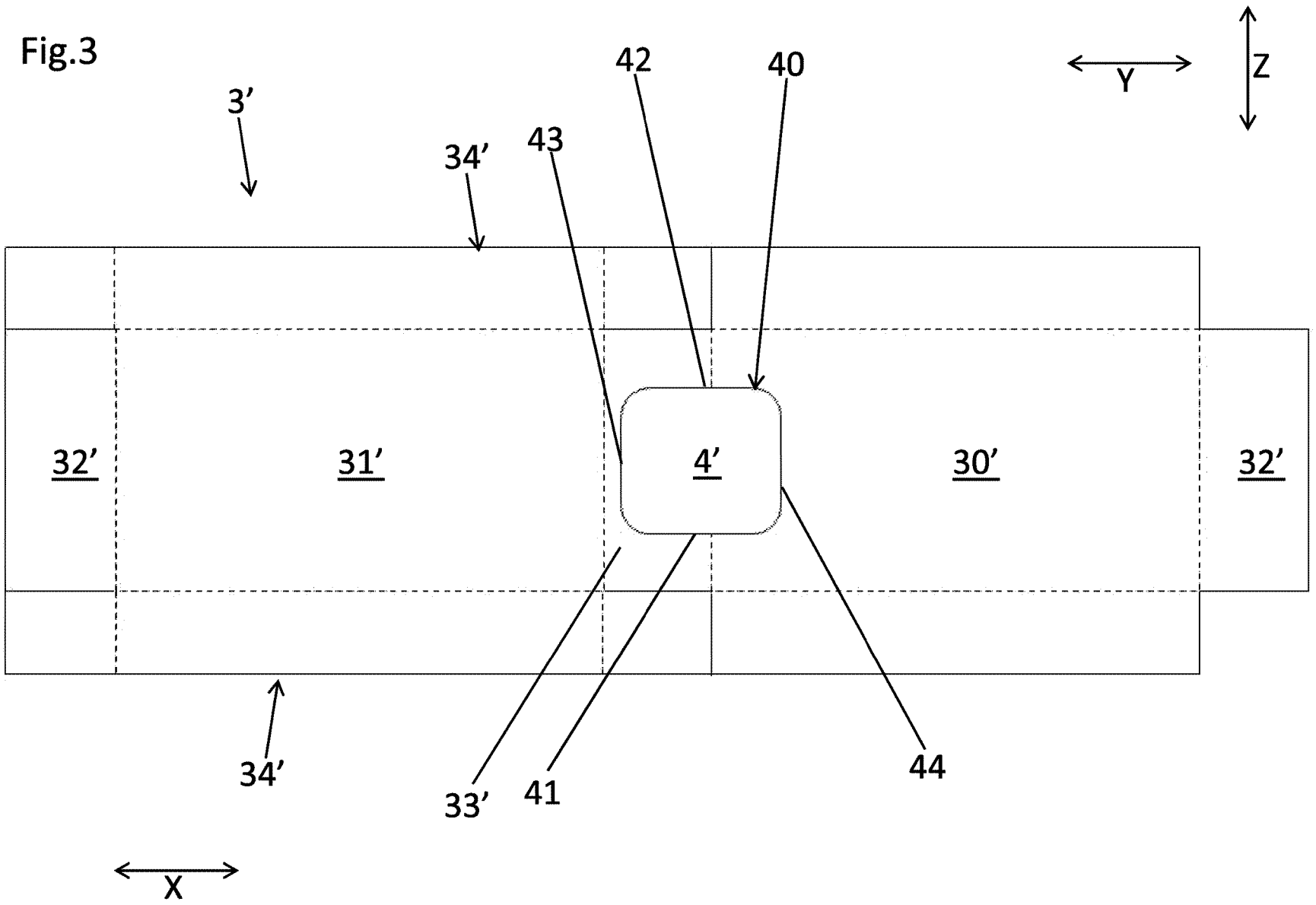
FIGS. 3 and 4 are plan views of a sheet of material, for manufacturing the wrapping of a packet object of the present invention, as an alternative to that of FIG. 2.

With reference to FIG. 3, an alternative blank to that illustrated in FIG. 2 is shown. In detail, the blank of FIG. 3 is made of the same material as that of FIG. 2 and differs only in some cutting or folding lines of the blank.

Figure 4:
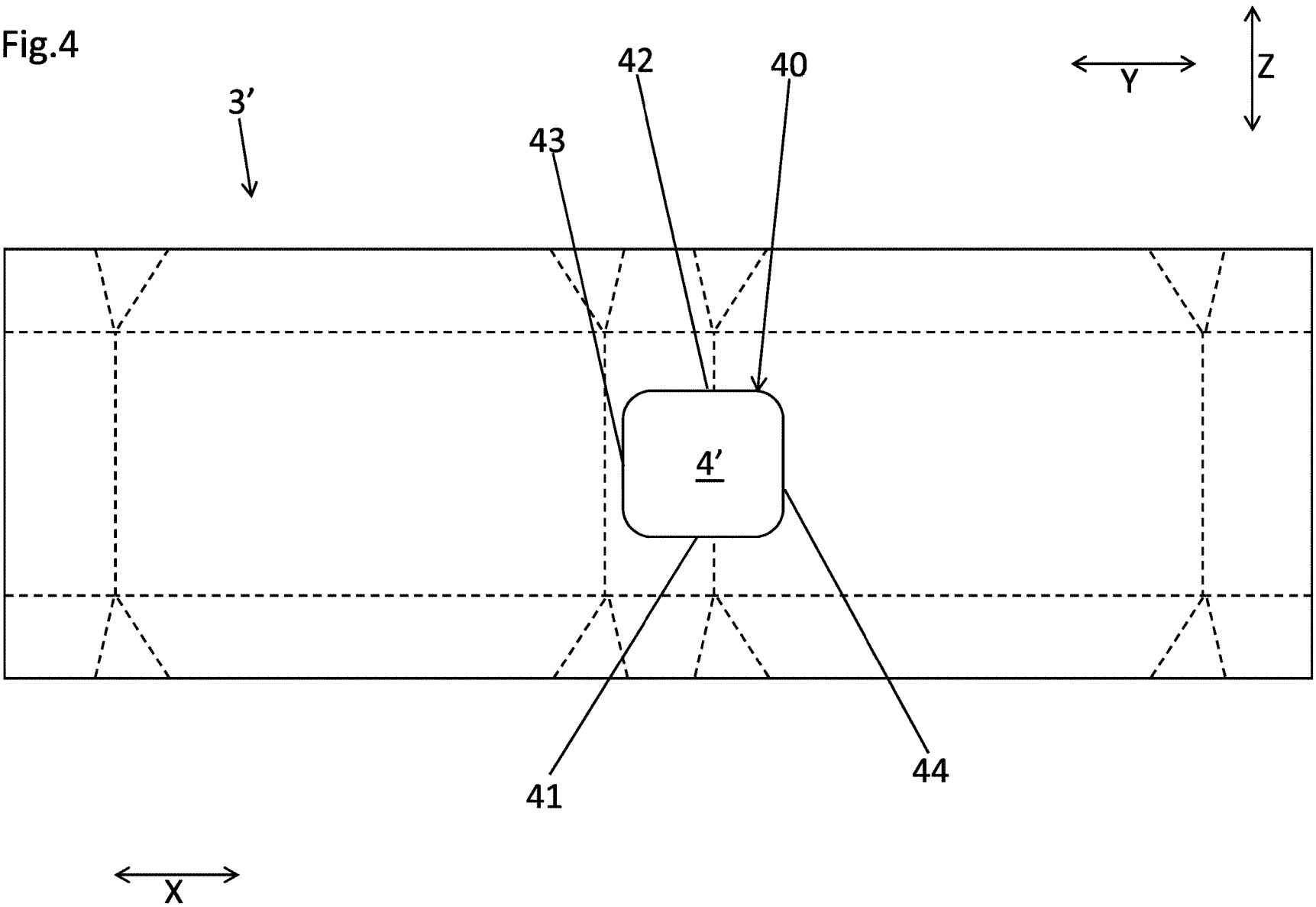
Figure 6:
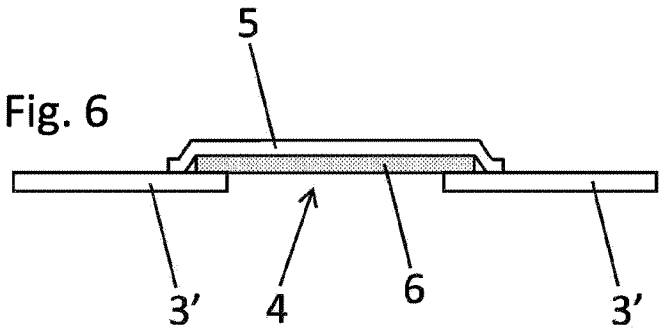
FIG. 6 is a section view of FIG. 5, along the section V-V.
Figure 7:
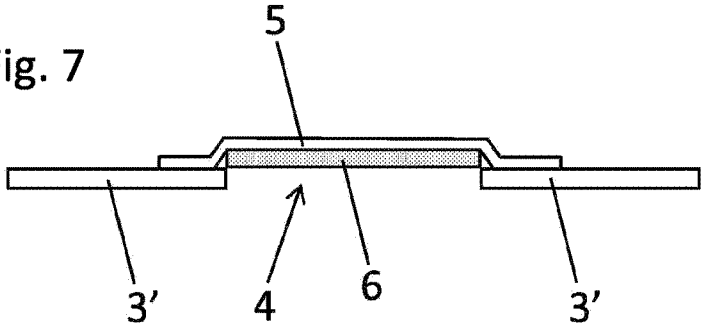
FIG. 7 is a section view of FIG. 5, along the section VI-VI.

Alternatively, the sheet 3' having a prevalent development direction X which is designed to form the wrapping 3 can be a sheet of heat-sealable material (FIG. 4). In said embodiment, the packet 1 could also comprise a frame (not illustrated) arranged inside the wrapping 3. The frame is made of a material more rigid than the sheet 3', for example made of cardboard, and could partially surround the group of smoking articles 2. For example, the frame could have a U-shaped cross section.

The edge 40 of the extraction opening comprises a first side 41, a second side 42 opposed to the first side 41, a third side 43 transversal to the first side 41 and to the second side 42 and a fourth side 44 opposed to the third side 43 and transversal to the first side 41 and to the second side 42.

Figure 5:
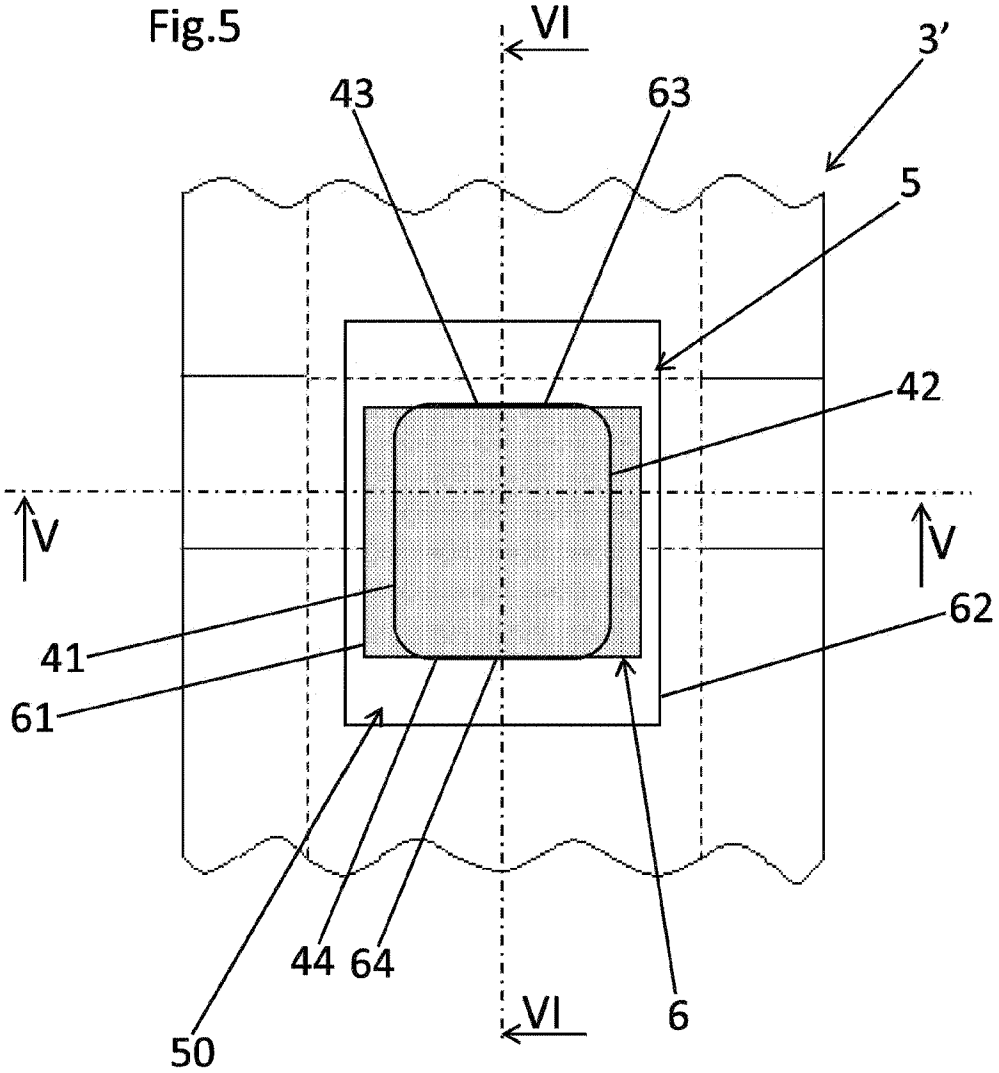
FIG. 5 is an enlarged plan view of a part of the wrapping of FIG. 2 in which the closing label and the covering element are fixed.

With particular reference to FIGS. 2 and 5, the extraction opening 4 has a first development direction Y parallel to the prevalent development direction X of the wrapping 3 and a second development direction Z orthogonal to the first development direction Y. Furthermore, again with reference to FIGS. 2 and 5, the edge 40 of the extraction opening 4 has a substantially rectangular shape (with rounded corners). In other words, the first side 41 and the second side 42 are opposed and parallel to one another (and parallel to the first development direction Y) and the third side 43 and the fourth side 44 are opposed and parallel to one another (and parallel to the second development direction Z).

Preferably, the covering element 6 comprises a first side 61, a second side 62 opposed to the first side 61, a third side 63 transversal to the first side 61 and to the second side 62 and a fourth side 64 opposed to the third side 63 and transversal to the first side 61 and to the second side 62.

With further reference to FIG. 5, the covering element 6 has a first development direction Y parallel to the prevalent development direction X of the wrapping 3 and a second development direction Z orthogonal to the first development direction Y. Furthermore, again with reference to FIG. 5, the covering element 6 has a rectangular shape. In other words, the first side 61 and the second side 62 are opposed and parallel to one another (and parallel to the first development direction Y) and the third side 63 and the fourth side 64 are opposed and parallel to one another (and parallel to the second development direction Z).

It is understood that the covering element 6 could have a different shape than the one illustrated in the attached Figures. For example, the covering element 6 could have rounded corners, or a square shape or a non-polygonal shape.

The covering element 6 protrudes beyond the edge 40 of the extraction opening 4 at the first side 41 and at the second side 42 of the edge 40 (FIG. 5).

In this case, supposing that to make the packet 1 the covering element 6 is first fixed to the closing label 5 and then the assembly made by the closing label 5 and the covering element 6 are fixed to the sheet 3' designed to define the wrapping 3 at the extraction opening 4, it is obvious that the closing label 5 must be fixed in a precise manner to the sheet 3' to ensure that the covering element 6 covers the extraction opening 4.

As said operation is more precise in the prevalent development direction X of the sheet 3', it is advantageous to provide for the covering element 6 to protrude beyond the edge 40 of the extraction opening 4 at the first side 41 and at the second side 42 of the edge 40. In fact, even if, in the direction orthogonal to the prevalent development direction X of the sheet 3', there is a less precise positioning of the closing label 5, there is no risk of leaving part of the extraction opening 4 free, i.e. not covered by the covering element 6.

With further reference to FIGS. 1 and 5, the third side 63 and the fourth side 64 of the covering element 6 are arranged at a zero distance respectively from the third side 43 and from the fourth side 44 of the edge 40 of the extraction opening 4.

Advantageously, the material used in manufacturing the packet 1 is reduced and the positioning precision of the closing label 5 is increased, in the prevalent development direction X of the sheet 3', ensuring that the extraction opening 4 is completely covered by the covering element 6.

In other words, the distance between the first side 41 and the second side 42 of the edge 40 of the extraction opening 4 is less than the distance between the first side 61 and the second side 62 of the covering element 6 and the distance between the third side 43 and the fourth side 44 of the edge 40 of the extraction opening 4 is equal to the distance between the first side 61 and the second side 62 of the covering element 6.

Preferably, the covering element 6 is a flat element having a profile with the same shape as the edge 40 of the extraction opening 4. In other words, if the edge 40 of the extraction opening 4 is a rectangle then the profile of the covering element 6 is rectangular. In any case, the profile of the covering element 6 does not have the same length as the edge 40 of the extraction opening 4.

The covering element 6 is in the form of a sheet of material fixed (glued) to the closing label 5.

Preferably, the covering element 6 is made of a material comprising at least one layer of paper, the which paper layer is facing the group of smoking articles 2 when the closing label 5 is in the closing position A.

Advantageously, the smoking articles are in contact with a paper material also at the extraction opening 4.

Moreover, the closing element 6 can also comprise a further layer of aluminium or plastic and said further layer is arranged on the face of the paper layer opposed to the one facing the group of smoking articles 2.

Alternatively, the closing element 6 could be entirely made in a plastic material or entirely in a paper material.

The closing label 5 can be made of a plastic material. The closing label 5 comprises adhesive material, at the respective face facing the group of smoking articles 2.

In particular, the closing label 5 is glued (with strong or weak glue) to the wrapping 3 at the respective rear wall 31. Furthermore, the closing label 5 is glued with weak glue (called "re-stick") to the wrapping 3 at the edge 40 of the extraction opening 4. In other words, the closing label 5 in the closed configuration B adheres to the wrapping 3 all around the extraction opening 4.

Furthermore, the closing label 5 is glued (with strong or weak glue) to the covering element 6. In detail, when the covering element 6 is fixed to the closing label 5, an edge of the closing label 5 is defined, which is designed to be fixed to the wrapping 3 (one part at the rear wall 31 and one part around the extraction opening 4).

With further reference to FIGS. 1 and 5, the closing label 5 comprises a flap 50 without glue. This flap 50 can be handled by the user in order to easily detach/attach the closing label 5 from/to the wrapping 3.

When the closing label 5 is in the closing position A, said flap 50 faces the front wall 30 of the wrapping 3.

Alternatively, the closing label 5 could be glued (with strong or weak glue) to the wrapping 3 at the respective rear wall 31 and with weak glue (called "re-stick") to the wrapping 3 at only one part of the edge 40 of the extraction opening 4.

With reference to FIGS. 8-10 and 13, alternative embodiments of the packet 1 described above are illustrated.

Figure 8:
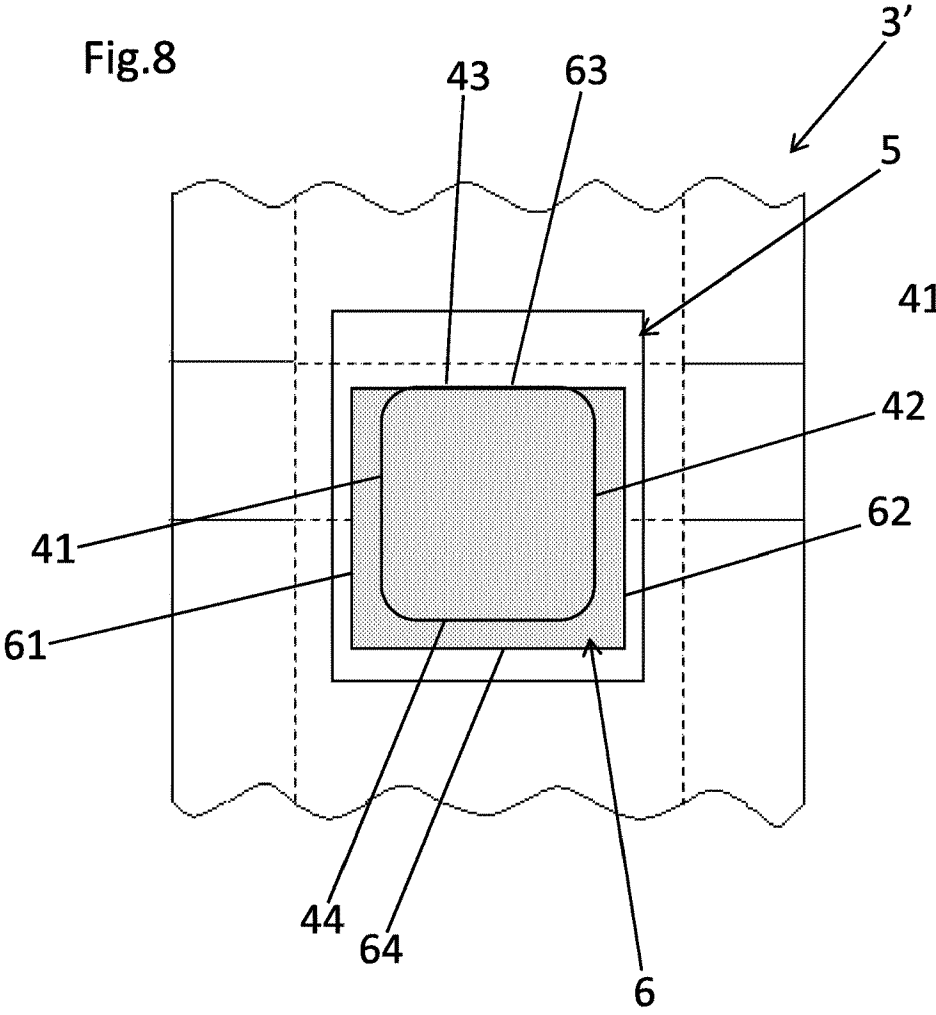

With reference to FIG. 8, all the peculiarities described with reference to the packet 1 of FIGS. 1, 2, 5-7 are verified, with the exception of the fact that the covering element 6 protrudes beyond the edge 40 of the extraction opening 4 at the first side 41, at the second side 42 and at the fourth side 44 of the edge 40. In this embodiment, the third side 63 of the covering element 6 is arranged at a zero distance from the third side 43 of the edge 40 of the extraction opening 4. In other words, the distance between the first side 41 and the second side 42 of the edge 40 of the extraction opening 4 is smaller than the distance between the first side 61 and the second side 62 of the covering element 6 such as the distance between the third side 43 and the fourth side 44 of the edge 40 of the extraction opening 4 is greater than the distance between the third side 63 and the fourth side 64 of the covering element 6.

Advantageously, it is further easier to apply the label 5 to the sheet 3' ensuring that the covering element 6 completely covers the extraction opening 4 of the wrapping 3.

Figure 9:
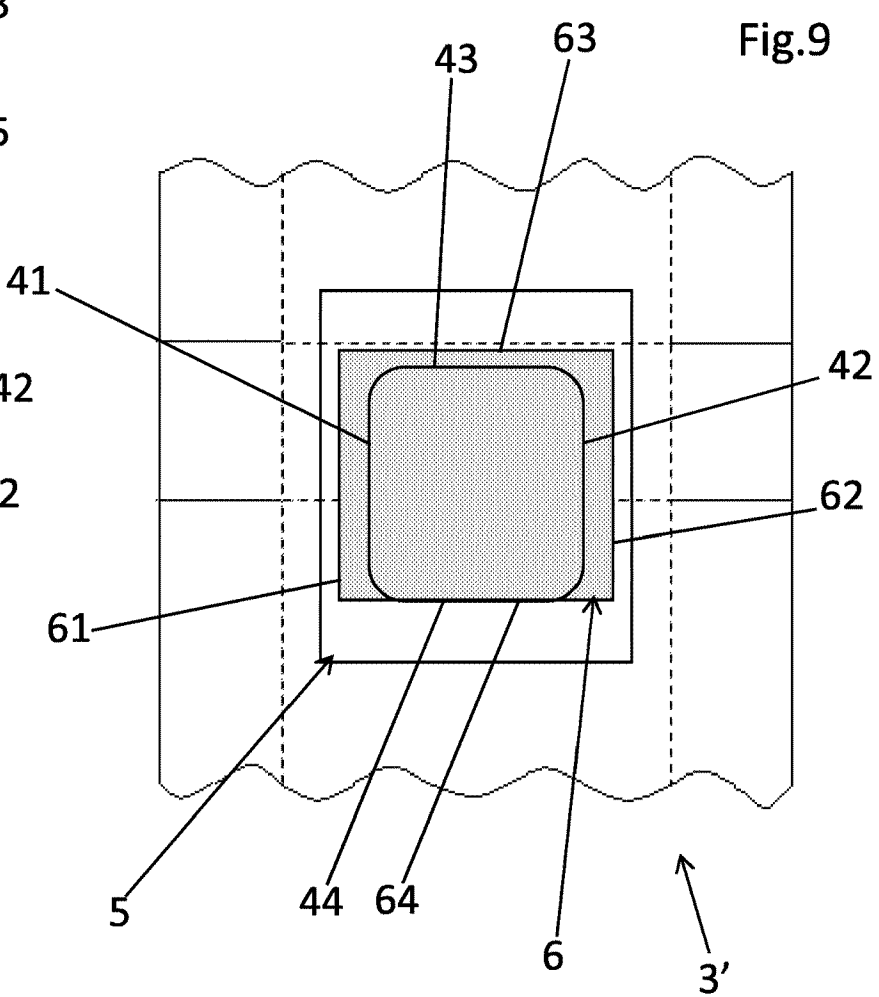
FIGS. 8, 9, 10 and 13 are similar to the view of FIG. 5, in which different embodiments of the covering element are illustrated.

With reference to FIG. 9, all the peculiarities described with reference to the packet 1 of FIGS. 1, 2, 5-7 are verified, with the exception of the fact that the covering element 6 protrudes beyond the edge 40 of the extraction opening 4 at the first side 41, at the second side 42 and at the third side 43 of the edge 40. In said embodiment, the fourth side 64 of the covering element 6 is arranged at a zero distance from the fourth side 44 of the edge 40 of the extraction opening 4. In other words, the distance between the first side 41 and the second side 42 of the edge 40 of the extraction opening 4 is smaller than the distance between the first side 61 and the second side 62 of the covering element 6 such as the distance between the third side 43 and the fourth side 44 of the edge 40 of the extraction opening 4 is smaller than the distance between the third side 63 and the fourth side 64 of the covering element 6.

Advantageously, it is further easier to apply the label 5 to the sheet 3' ensuring that the covering element 6 completely covers the extraction opening 4 of the wrapping 3.

Figure 10:
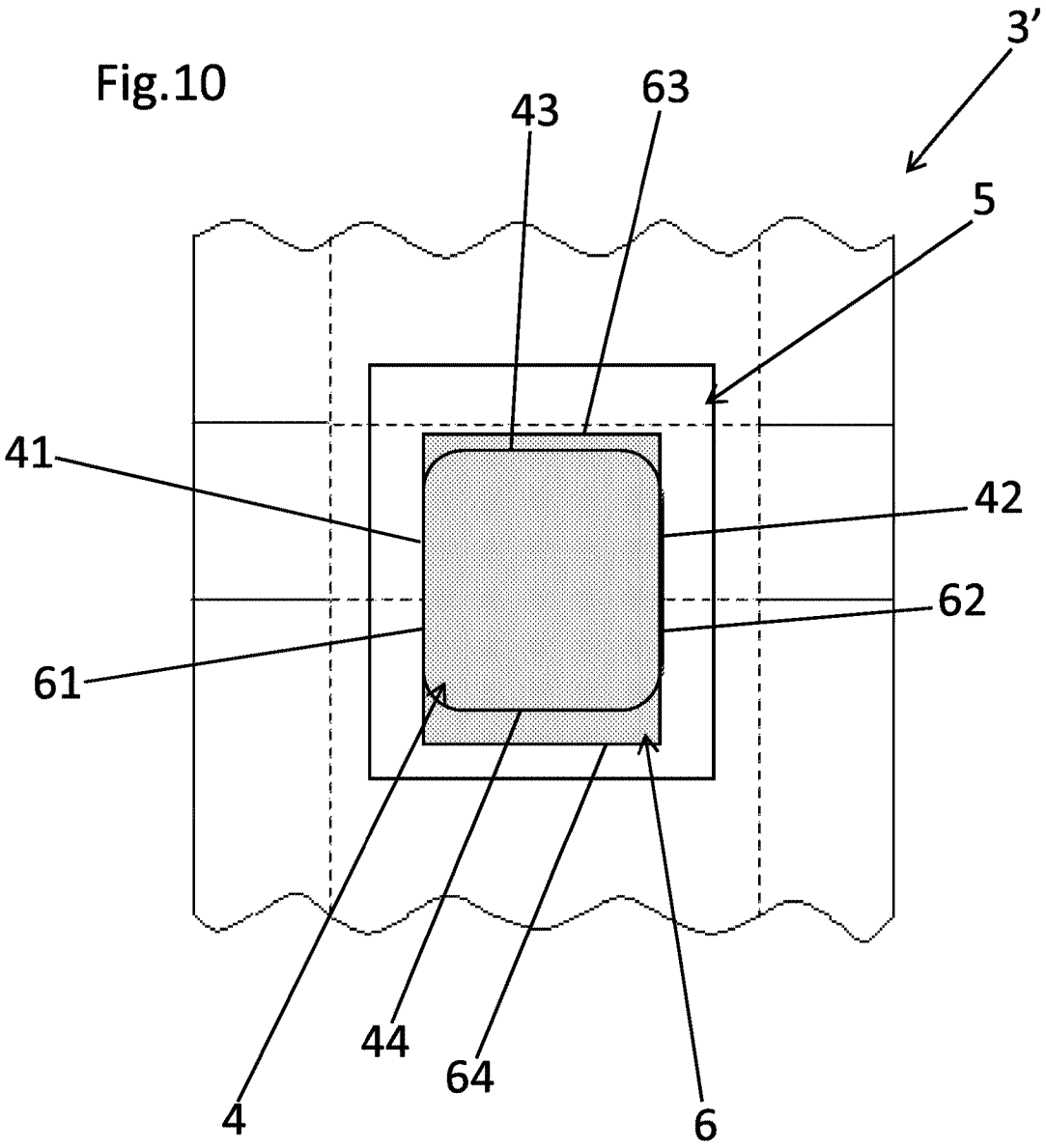

With reference to FIG. 10, all the peculiarities described with reference to the packet 1 of FIGS. 1, 2, 5-7 are verified, with the exception of the fact that the covering element 6 protrudes beyond the edge 40 of the extraction opening 4 at the third side 43 and at the fourth side 44 of the edge 40. In said embodiment the first side 61 and the second side 62 of the covering element 6 are arranged at a zero distance respectively from the first side 41 and from the second side 42 of the edge 40 of the extraction opening 4. In other words, the distance between the first side 41 and the second side 42 of the edge 40 of the extraction opening 4 is equal to the distance between the first side 61 and the second side 62 of the covering element 6 such as the distance between the third side 43 and the fourth side 44 of the edge 40 of the extraction opening 4 is smaller than the distance between the third side 63 and the fourth side 64 of the covering element 6.

The solution of FIG. 10 is particularly advantageous in the case where the positioning of the closing label 5 on the sheet 3' is more precise in the direction orthogonal to the prevalent development direction X with respect to that in the prevalent development direction X.

Alternatively, according to an embodiment not illustrated, the covering element 6 can protrude beyond the edge 40 of the extraction opening 4 at the first side 41, at the third side 43 and at the fourth side 44 of the edge 40. In this embodiment, the second side 62 of the covering element 6 is arranged at a zero distance from the second side 42 of the edge 40 of the extraction opening 4.

Or, as a further alternative not illustrated, the covering element 6 can protrude beyond the edge 40 of the extraction opening 4 at the second side 42, at the third side 43 and at the fourth side 44 of the edge 40. In said embodiment, the first side 61 of the covering element 6 is arranged at a zero distance from the first side 41 of the edge 40 of the extraction opening 4.

Figure 13:
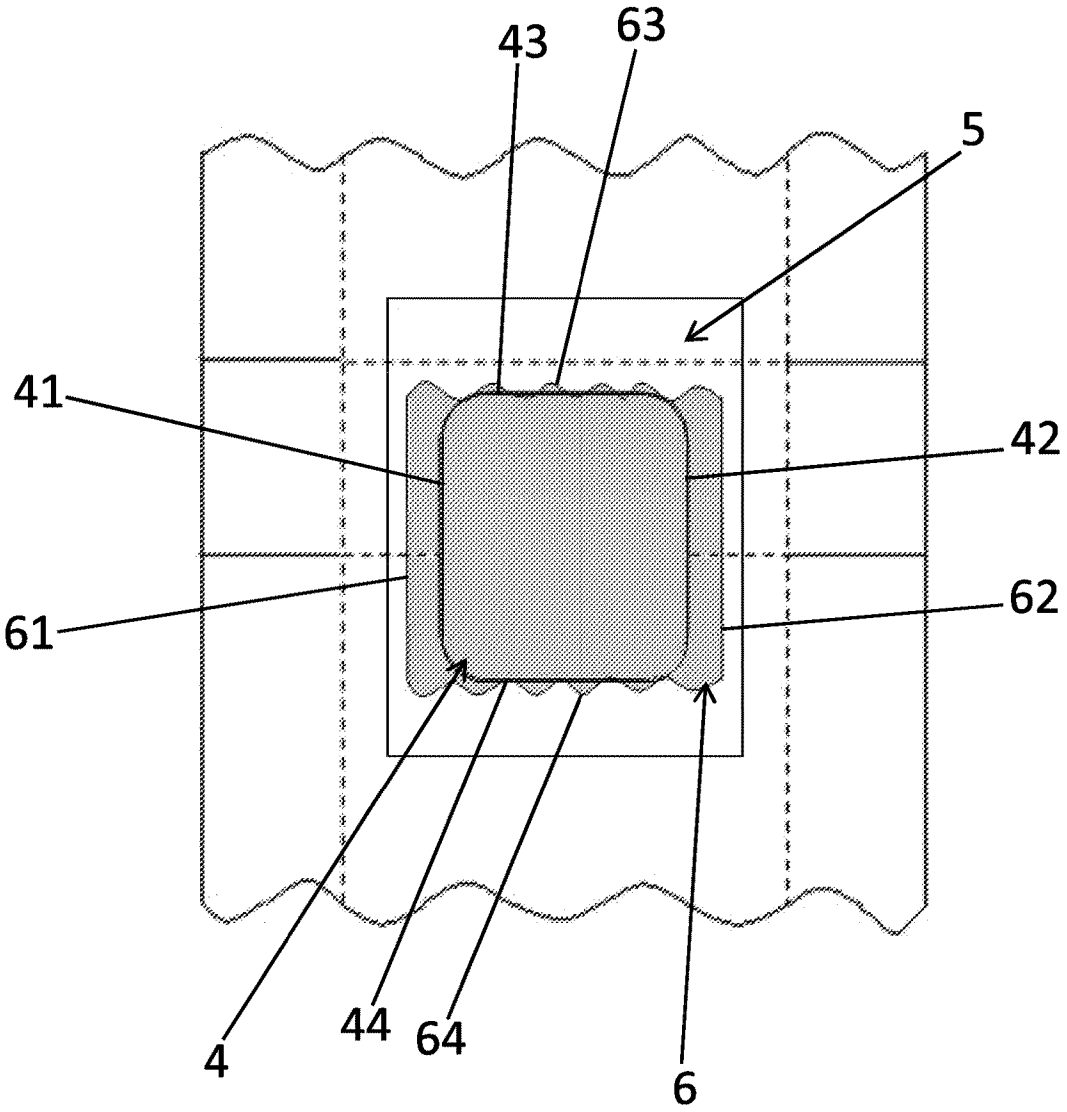

With reference to FIG. 13, all the peculiarities described with reference to the packet 1 of FIGS. 1, 2, 5-7 are verified, except for the fact that the covering element 6 has the third side 63 and the fourth side 64 undulated (i.e. non-linear); in other words, the closing element 6 does not have a polygonal perimeter. In said embodiment, the covering element 6 protrudes beyond the edge 40 of the extraction opening 4 at the third side 43 and at the fourth side 44 of the edge 40 but not completely: in particular each "peak" (apex of the convex part of the sides in relation to the inside of the extraction opening 4) of the third side 63 and of the fourth side 64 protrudes beyond the edge 40 of the extraction opening 4 whereas each "swell" (minimum of the concave part of the sides relative to the inside the extraction opening 4) of the third side 63 and of the fourth side 64 is arranged at/near the edge 40 of the extraction opening 4. The minimum point of each "swell" does not protrude beyond the edge 40 of the extraction opening 4: or it is arranged at a zero distance from the edge 40 or faces the extraction opening 4 always near the edge 40.

It is understood that also the first side 61 and/or the second side 62 can be undulated (alternatively or with also the third side 63 and/or the fourth side 64 undulated).

Advantageously, said embodiment of the closing element 6 is not sensitive to the tolerances of the application of the closing label 5 to the sheet 3'. Moreover, also this embodiment allows to avoid the closing label 5 (in particular, the glue of the closing label 5) being in contact with the smoking articles 2 arranged inside the wrapping 3 and at the same time allows to minimize the quantity of material used for manufacturing the packet 1.

According to the FIGS. 11 and 12, a further embodiment of the packet 1 of the present invention is described in the following. For said packet 1 all the peculiarities described with reference to the packet 1 of FIGS. 1, 2, 5-7 are verified. Furthermore, said packet 1 comprises a container 7 which contains the wrapping 3 and the group of smoking articles 2 and which, in turn, comprises an opening 70 from which the wrapping 3 protrudes (and the group of smoking articles 2), a bottom wall 71 opposed to the opening 70 and a side wall 71 which rises from the bottom wall 71 and which defines the opening 70.

Figure 12:
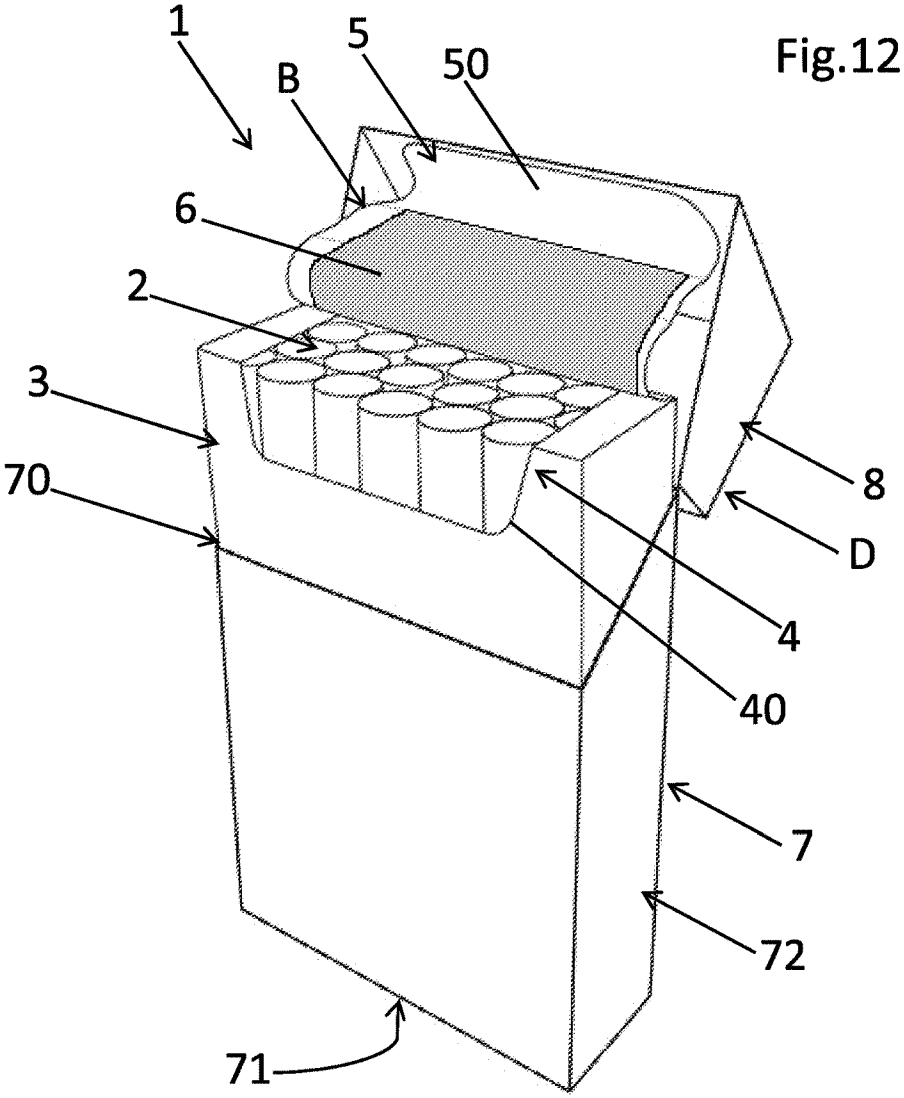
FIGS. 11 and 12 are front perspective views of a further embodiment of the packet object of the present invention in respective operating configurations.

With particular reference to FIG. 12, the container 7 is cup-shaped and has a rectangular parallelepiped shape orientated in a vertical prevalent development direction.

Furthermore, the packet 1 comprises a lid 8 which is hinged to the container 7 to rotate with respect to the container 7 between a first position C (FIG. 11), in which it closes the opening 70 of the container 7, and a second position D (FIG. 12), where access to the wrapping 3 is allowed through the opening 70.

The lid 8 comprises an open lower end (facing the opening 70 of the container 7 when the lid 8 is in the first position C). The lid 8 is cup-shaped and has a substantially rectangular parallelepiped shape.

Figure 11:
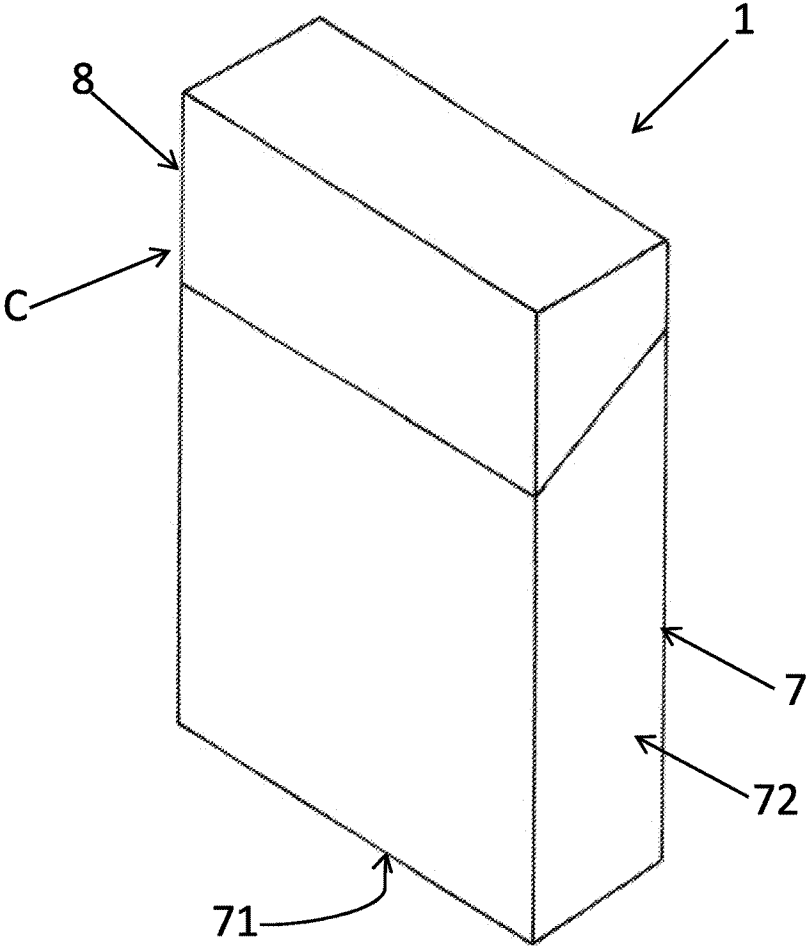

Alternatively to what is illustrated in FIGS. 11 and 12, the container 7 and/or the lid 8 could have rounded corners.

Furthermore, with further reference to FIG. 12, in said embodiment the closing label 5 can be fixed (glued with strong glue, or in any case designed not to be separated) to the lid 8. In detail, the closing label 5 (in particular the flap 50) can be fixed to a wall of the lid 8 so that by moving the lid 8 from the first position C to the second position D the closing label 5 is moved from the closing position A to the opening position B.

Furthermore, according to said embodiment, the wrapping 3 may not completely enclose the group of smoking articles 2. For example, the wrapping 3 could leave the end of the smoking articles 2, arranged near the bottom wall 71 of the container 7, uncovered. In said case, said end of the smoking articles 2 could be covered by a further wrapping, for example a wrapping made of foil.

The method for carrying out any of the embodiments of the packet 1 described above is described in the following. This method comprises the steps of: providing a sheet 3' designed to define the wrapping 3, the which sheet 3' comprises the extraction opening 4 defined by the edge 40; providing the covering element 6 fixed to the closing label 5.

Furthermore, the method comprises the step of fixing the closing label 5 to the sheet 3' designed to define the wrapping 3 so that: the covering element 6 faces and covers the extraction opening 4 and protrudes beyond the edge 40 of the extraction opening 4 at a partial part of the edge 40; the closing label 5 is mobile between the closing position A, in which it closes the extraction opening 4, and the opening position B, in which access to the group of smoking articles 2 is allowed.

Finally, the method comprises the step of forming the wrapping 3 by folding the sheet 3' with the closing label 5 applied thereon.

In detail, the step of providing the covering element 6 fixed to the closing label 5 comprises the steps of: providing the covering element 6; providing the closing label 5; fixing the covering element 6 to the closing label 5.

The step of fixing the closing label 5 to the sheet 3' is carried out after the step of fixing the covering element 6 to the closing label 5.

As an alternative, the method could also provide that the steps of providing the sheet 3', providing the covering element 6 fixed to the closing label 5 and the step of fixing the closing label 5 to the sheet 3' which are carried out in a separate site (for example, in another plant) with respect to the site where the wrapping 3 was formed.

The invention claimed is:

1. A packet (1) of smoking articles, comprising:

a group of smoking articles (2);

a wrapping (3) which encloses the group of smoking articles (2) and that comprises an extraction opening (4) for extracting the smoking articles (2) from the wrapping (3), the extraction opening (4) is defined by an edge (40);

a closing label (5), which is fixed to the wrapping (3) and that is mobile between a closing position (A), in which it closes the extraction opening (4) of the wrapping (3), and an opening position (B), in which the access to the group of smoking articles (2) is allowed; and a covering element (6), which is fixed to the closing label (5) and that faces and covers the extraction opening (4) when the closing label (5) is in the closing position (A);

wherein the covering element (6) protrudes beyond the edge (40) of the extraction opening (4) at a partial part of the edge (40), when the closing label (5) is in the closing position (A));

wherein the edge (40) of the extraction opening (4) and the covering element (6) each comprise a first side (41, 61), a second side (42, 62) opposed to the first side (41, 61), a third side (43, 63) transversal to the first side (41, 61) and to the second side (42, 62) and a fourth side (44, 64) opposed to the third side (43, 63) and transversal to the first side (41, 61) and to the second side (42, 62);

wherein the covering element (6) protrudes beyond the edge (40) of the extraction opening (4) at the first side (41) and at the second side (42) of the edge (40); and wherein the third side (63) and the fourth side (64) of the covering element (6) are arranged at a zero distance from the third side (43) and from the fourth side (44) of the edge (40) of the extraction opening (4), respectively.

2. The packet (1) according to claim 1, wherein:

the wrapping (3) is obtained by folding a sheet (3') having a prevalent development direction (X) and the extraction opening (4) has a first development direction (Y) parallel to the prevalent development direction (X) and a second development direction (Z) orthogonal to the first development direction (Y);

the first side (41) and the second side (42) of the edge (40) of the extraction opening (4) and the first side (61) and the second side (62) of the covering element (6) are parallel to the first development direction (Y);

the third side (43) and the fourth side (44) of the extraction opening (4) and the third side (63) and the fourth side (64) of the covering element (6) are parallel to the second development direction (Z).

3. The packet (1) according to claim 2, wherein:

the covering element (6) protrudes beyond the edge (40) of the extraction opening (4) at the first side (41) and at the second side (42) of the edge (40); and the distance between the first side (41) and the second side (42) of the edge (40) of the extraction opening (4) is less than the distance between the first side (61) and the second side (62) of the covering element (6) and the distance between the third side (43) and the fourth side (44) of the edge (40) of the extraction opening (4) is equal to the distance between the third side (63) and the fourth side (64) of the covering element (6).

4. The packet (1) according to claim 1, wherein the covering element (6) is a flat element having a profile with the same shape as the edge (40) of the extraction opening (4).

5. The packet (1) according to claim 1, wherein the covering element (6) is made of a material comprising at least one layer of paper, the which paper layer faces the group of smoking articles (2) when the closing label (5) is in the closing position (A).

6. A method for manufacturing a packet (1) of smoking articles according to claim 1, comprising the steps of:

providing a sheet (3') designed to define the wrapping (3), the which sheet (3') comprises the extraction opening (4) defined by the edge (40);

providing the covering element (6) fixed to the closing label (5);

fixing the closing label (5) to the sheet (3') so that: the covering element (6) faces and covers the extraction opening (4) and protrudes beyond the edge (40) of the extraction opening (4) at a partial part of the edge (40); the closing label (5) is mobile between a closing position (A), in which it closes the extraction opening (4), and an opening position (B), in which the access to the group of smoking articles (2) is allowed;

forming the wrapping (4) by folding the sheet (3') with the closing label (5) applied thereon.

7. The method according to claim 6, wherein the step of providing the covering element (6) fixed to the closing label (5) comprises the steps of: providing the covering element (6); providing the closing label (5); fixing the covering element (6) to the closing label (5).

8. A packet (1) of smoking articles, comprising:

a group of smoking articles (2);

a wrapping (3) which encloses the group of smoking articles (2) and that comprises an extraction opening (4) for extracting the smoking articles (2) from the wrapping (3), the extraction opening (4) is defined by an edge (40);

a closing label (5), which is fixed to the wrapping (3) and that is mobile between a closing position (A), in which it closes the extraction opening (4) of the wrapping (3), and an opening position (B), in which the access to the group of smoking articles (2) is allowed; and a covering element (6), which is fixed to the closing label (5) and that faces and covers the extraction opening (4) when the closing label (5) is in the closing position (A);

wherein the covering element (6) protrudes beyond the edge (40) of the extraction opening (4) at a partial part of the edge (40), when the closing label (5) is in the closing position (A); wherein the edge (40) of the extraction opening (4) and the covering element (6) each comprise a first side (41, 61), a second side (42, 62) opposed to the first side (41, 61), a third side (48, 63) transversal to the first side (41, 61) and to the second side (42, 62) and a fourth side (44, 64) opposed to the third side (43, 63) and transversal to the first side (41, 61) and to the second side (42, 62);

wherein the wrapping (3) is obtained by folding a sheet (3') having a prevalent development direction (X) and the extraction opening (4) has a first development direction (Y) parallel to the prevalent development direction (X) and a second development direction (Z) orthogonal to the first development direction (Y);

wherein the first side (41) and the second side (42) of the edge (40) of the extraction opening (4) and the first side (61) and the second side (62) of the covering element (6) are parallel to the first development direction (Y);

wherein the third side (43) and the fourth side (44) of the extraction opening (4) and the third side (63) and the fourth side (64) of the covering element (6) are parallel to the second development direction (Z);

wherein the covering element (6) protrudes beyond the edge (40) of the extraction opening (4) at the first side (41) and at the second side (42) of the edge (40); and wherein the distance between the first side (41) and the second side (42) of the edge (40) of the extraction opening (4) is less than the distance between the first side (61) and the second side (62) of the covering element (6) and the distance between the third side (43) and the fourth side (44) of the edge (40) of the extraction opening (4) is equal to the distance between the third side (63) and the fourth side (64) of the covering element (6).

* * * * *